US008052526B2

(12) United States Patent
Abbott et al.

(10) Patent No.: US 8,052,526 B2
(45) Date of Patent: Nov. 8, 2011

(54) METHOD AND APPARATUS FOR PEER-TO-PEER WAGERING GAME

(75) Inventors: Eric L. Abbott, Las Vegas, NV (US); Brandon D. Knowles, Las Vegas, NV (US); Robert B. Ziems, Las Vegas, NV (US)

(73) Assignee: IGT, Reno, NV (US)

( * ) Notice: Subject to any disclaimer, the term of this patent is extended or adjusted under 35 U.S.C. 154(b) by 1121 days.

(21) Appl. No.: 11/517,011

(22) Filed: Sep. 6, 2006

(65) Prior Publication Data

US 2007/0087832 A1 Apr. 19, 2007

Related U.S. Application Data

(60) Provisional application No. 60/715,630, filed on Sep. 9, 2005.

(51) Int. Cl.
*A63F 9/24* (2006.01)

(52) U.S. Cl. ..... 463/29

(58) Field of Classification Search ..... 463/29
See application file for complete search history.

(56) References Cited

U.S. PATENT DOCUMENTS 4,764,666 A 8/1988 Bergeron
4,926,327 A 5/1990 Sidley
5,116,055 A 5/1992 Tracy
5,280,909 A 1/1994 Tracy
5,344,144 A 9/1994 Canon
5,618,045 A * 4/1997 Kagan et al. ..... 463/40
5,770,533 A 6/1998 Franchi
5,797,085 A * 8/1998 Beuk et al. ..... 455/88
6,110,043 A 8/2000 Olsen
6,146,273 A 11/2000 Olsen
6,186,895 B1 2/2001 Oliver
6,217,448 B1 4/2001 Olsen
6,241,608 B1 6/2001 Torango
6,264,561 B1 7/2001 Saffari et al.
6,267,671 B1 7/2001 Hogan
6,358,150 B1 3/2002 Mir et al.
6,435,968 B1 8/2002 Torango
6,450,887 B1 9/2002 Mir et al.
6,464,584 B2 10/2002 Oliver
6,508,709 B1 1/2003 Karmarkar
6,508,710 B1 * 1/2003 Paravia et al. ..... 463/42
6,592,460 B2 7/2003 Torango
(Continued)

FOREIGN PATENT DOCUMENTS

AU 589158 2/1986
(Continued)

*Primary Examiner* — Corbett B Coburn
(74) *Attorney, Agent, or Firm* — Armstrong Teasdale LLP

(57) ABSTRACT

A wagering game system includes at least one server configured to generate wagering event data for presentation to players that play against each other using the wagering event data, and generate a bonus award to be provided to at least one of the players, wherein the bonus award includes at least one of a progressive jackpot and a mystery jackpot. The wagering game system also includes at least one wagering device configured to present the wagering event data to a player and receive player input from the player, and an interface device configured to communicate with the wagering device to provide wagering event data to the wagering device, and send player input from the wagering device to the server, wherein the player utilizes the wagering device to play against other players based on the wagering event data.

20 Claims, 9 Drawing Sheets

U.S. PATENT DOCUMENTS

| | | | | |
|---|---|---|---|---|
| 6,656,048 | B2 | 12/2003 | Olsen | |
| 6,659,871 | B2 | 12/2003 | Leifer et al. | |
| 6,685,564 | B2 | 2/2004 | Oliver | |
| 6,719,633 | B1 | 4/2004 | Leifer et al. | |
| 6,743,104 | B1 | 6/2004 | Ota et al. | |
| 6,811,489 | B1 | 11/2004 | Shimizu et al. | |
| 6,837,793 | B2 | 1/2005 | McClintic | |
| 6,878,066 | B2 | 4/2005 | Leifer et al. | |
| 6,908,387 | B2 | 6/2005 | Hendrick et al. | |
| 6,908,390 | B2 | 6/2005 | Nguyen et al. | |
| 6,926,273 | B1 | 8/2005 | Vancura | |
| 7,029,395 | B1 | 4/2006 | Baerlocher | |
| 7,159,765 | B2 | 1/2007 | Frerking | |
| 7,162,036 | B2 | 1/2007 | Rowe | |
| 7,192,348 | B2 | 3/2007 | Brosnan et al. | |
| 7,203,841 | B2 | 4/2007 | Jackson et al. | |
| 2003/0109232 | A1* | 6/2003 | Park et al. | 455/90 |
| 2005/0032568 | A1 | 2/2005 | Griswold et al. | |
| 2005/0064926 | A1 | 3/2005 | Walker et al. | |
| 2005/0176499 | A1 | 8/2005 | Stronach | |
| 2006/0068899 | A1* | 3/2006 | White et al. | 463/25 |
| 2006/0177109 | A1 | 8/2006 | Storch | |
| 2007/0015584 | A1* | 1/2007 | Frenkel | 463/42 |
| 2007/0021194 | A1 | 1/2007 | Aida | |
| 2007/0021196 | A1 | 1/2007 | Campbell et al. | |
| 2007/0054732 | A1 | 3/2007 | Baerlocher | |
| 2007/0054733 | A1 | 3/2007 | Baerlocher | |
| 2007/0060314 | A1 | 3/2007 | Baerlocher et al. | |
| 2007/0060321 | A1 | 3/2007 | Vasquez et al. | |
| 2007/0105620 | A1 | 5/2007 | Cuddy et al. | |

FOREIGN PATENT DOCUMENTS

| | | |
|---|---|---|
| AU | 655801 | 3/1992 |

* cited by examiner

METHOD AND APPARATUS FOR PEER-TO-PEER WAGERING GAME

PRIORITY CLAIM

This application claims priority to U.S. Provisional Patent Application Ser. No. 60/715,630 filed on Sep. 9, 2005.

FIELD OF THE INVENTION

This invention relates generally to devices for gaming and more specifically to improved devices for both simulated and live wagering for peer-to-peer games.

BACKGROUND OF THE INVENTION

In the past, gaming establishments have offered a variety of devices and games to present wagering opportunities for players of games. The variety of games and devices both maintain and increase interest for players. The variety of games and devices also provide diversified profit centers for gaming establishments. For example, some players prefer table games with an opportunity to both wager and socialize. Other players prefer machine games, where in the prior art little socialization occurs. In prior art machine based games, the players attempt to "beat" the machine.

It has been possible to offer games to players on a mass scale with the growth of networking and hand held game playing devices. However, governmental and gaming regulatory requirements have limited the possibilities for offering networked wagering games. One consideration in offering remote wagering includes assurance that players are legally eligible and creditworthy (for example, children are excluded). Another consideration is that the games that are offered meet regulatory authority rules in terms of payback, fairness and methods of play. Yet another consideration is that monetary transactions do not violate regulatory prohibitions (for example, money laundering).

Operators of gaming establishments are continually being challenged to provide novel approaches to gaming to improve cash flow and profits. Machine wagering provides for maximized returns on investment because of the use of less real property space per player. Table games take up more real property space, and require more people intensive oversight.

SUMMARY OF THE INVENTION

Operators of waging games are highly motivated and would benefit from devices and systems for remote wagering on regulated games. Remote wagering devices and systems should be capable of securely permitting players to enter the wagering environment. Furthermore, such devices and systems should insure a secured transaction environment for an operator that meets both governmental and regulatory requirements. Additionally, wagering games of the players' choices should offer an environment that suits the players' personalities. Such an environment appeals to the greatest number of players. Currently, such devices and systems for remote wagering are unavailable in the gaming industry.

In one embodiment, wagering game system for providing a player versus player wagering event provided which comprises one or more servers configured to generate wagering event data for presentation to two or more players. In this embodiment, the two or more players play against each other using the wagering event data. The server also generates a bonus award to be provided to at least one of the two or more players. It is contemplated that the bonus award may comprise a progressive jackpot, a mystery jackpot, or both. Also part of this embodiment is at least one peer-to-peer device configured to present the wagering event data to a player and receive player input from the player. An interface is configured to communicate with two or more peer-to-peer devices to provide wagering event data to at least one peer-to-peer device and send player input from at least one peer-to-peer device to the server. Thus, the player utilizes the peer-to-peer devices to play against other players based on the wagering event data.

In one embodiment the progressive jackpot is awarded to a player based on a player receipt of a particular poker hand during play on the at least one peer-to-peer device. Likewise, the mystery award may be randomly awarded to a player during play on the peer-to-peer device. It is contemplated that the peer-to-peer device may communicate with the interface via a wireless communication link. Hence, the peer-to-peer device may be a mobile handheld device configured for use within designated areas in a casino establishment. It is further contemplated that the wagering system may further comprise interactive controls configured in the one or more servers, the peer-to-peer device, or both, wherein the interactive control determines whether to enable a camera on the peer-to-peer device. For example, the interactive control may be configured to display a player selectable icon instead of a picture or video of the player if the camera is not enabled.

Also disclosed herein is a wagering game system for providing a player versus player wagering event. This embodiment comprises one or more servers configured to generate wagering event data for presentation to two or more players such that the two or more players play against each other using the wagering event data. Also part of this embodiment is two or more peer-to-peer devices configured to present the wagering event data to a player and receive player input from the player. In this embodiment the two or more peer-to-peer devices are further configured to selectively display an image of a player during play. An interface is configured to communicate with two or more peer-to-peer devices to provide wagering event data to the two or more peer-to-peer devices and send player input from at least one peer-to-peer device to at least one server. Thus, the player utilizes at least one peer-to-peer device to play against other players based on the wagering event data.

In one embodiment the peer-to-peer device comprises a vibrating controller. In one embodiment the server is further configured to generate a bonus award to be provided to at least one of the two or more players, such that the bonus award comprises a progressive jackpot, a mystery jackpot, or both. It is contemplated that the progressive jackpot may be awarded in response to a particular game outcome received by a player playing on a peer-to-peer device. In aid in the interactivity of the game, the image of a player may comprise a video or a still image of the actual player playing on the peer-to-peer device. For example, the peer-to-peer device may be further configured with a camera to capture still or video image data. In addition, the player may select which wagering event to play on the peer-to-peer device. Likewise, the player selectively determines whether to display their image during play.

A method is provided for offering a wagering event to two or more players. In one embodiment this method comprises providing a peer-to-peer device to two or more players and generating wagering event data at a central server. The system then wirelessly transmitting wagering event data to two or more peer-to-peer devices and receives, via a wireless link, the wagering event at two or more peer-to-peer devices. This method also displays a wagering event to at least two players such that the wagering event is related to the wagering event data. One or more wagers are accepted from at least one player in response to the display of the wagering event and this is transmitted, via a wireless link, as player decision data regarding the wagering event to the central server. This method then determines a game outcome and a winning player at the central server and as a result, this method of operation provides an award to the winning player and may provide a bonus to a player. The bonus comprises a mystery jackpot or a progressive jackpot.

In one variation, the progressive jackpot is awarded to a player based on a particular game outcome which has been defined to generate a progressive jackpot win. In one embodiment the method further comprises receiving player interactivity input via the peer-to-peer device from a player such that the player interactivity input controls whether an image of the player will be shown to other players. As discussed herein in more detail, this method may further comprise capturing an image of a player with a camera in at least one peer-to-peer device and displaying the image of the player to other players of at least one other peer-to-peer device. To further add interactivity, the play of the peer-to-peer device may further comprising causing the two or more peer-to-peer device to vibrate in response to wagering event data.

The foregoing and other articles, features, and advantages of the invention will be apparent from the following more detailed description of the preferred embodiments of the invention, as illustrated in the accompanying drawings. The various features may be utilized or claimed alone or in any combination.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

In this application, certain terminology has been abbreviated to facilitate readability. Where a term has an abbreviation in parentheses following the term, the abbreviated version of the text may be used interchangeably.

To aid the reader, the following table provides a list of abbreviations as used herein.

WGS—wagering gaming system.
DTA—device tracking assembly.
TID—tracking interface device.
DOPS—device order processing servers.
GMIS—gaming media interface servers.
WI—wireless interfaces.
WLI—wire line interfaces.
IPIDS—initial player input data stream.
WLK—wire line kiosks.
WDK—wireless device kiosks.
RAD—remote authorization devices.

To overcome the drawbacks of the prior art and present new and exciting wagering opportunities, a method and apparatus is described herein which allows player to player wagering via a network environment and screen display. The following is but one possible example embodiment and example environment of use. One of ordinary skill in the art may arrive at other alternative methods of embodiment the method and apparatus described herein.

Environment of Use

Figure 1:
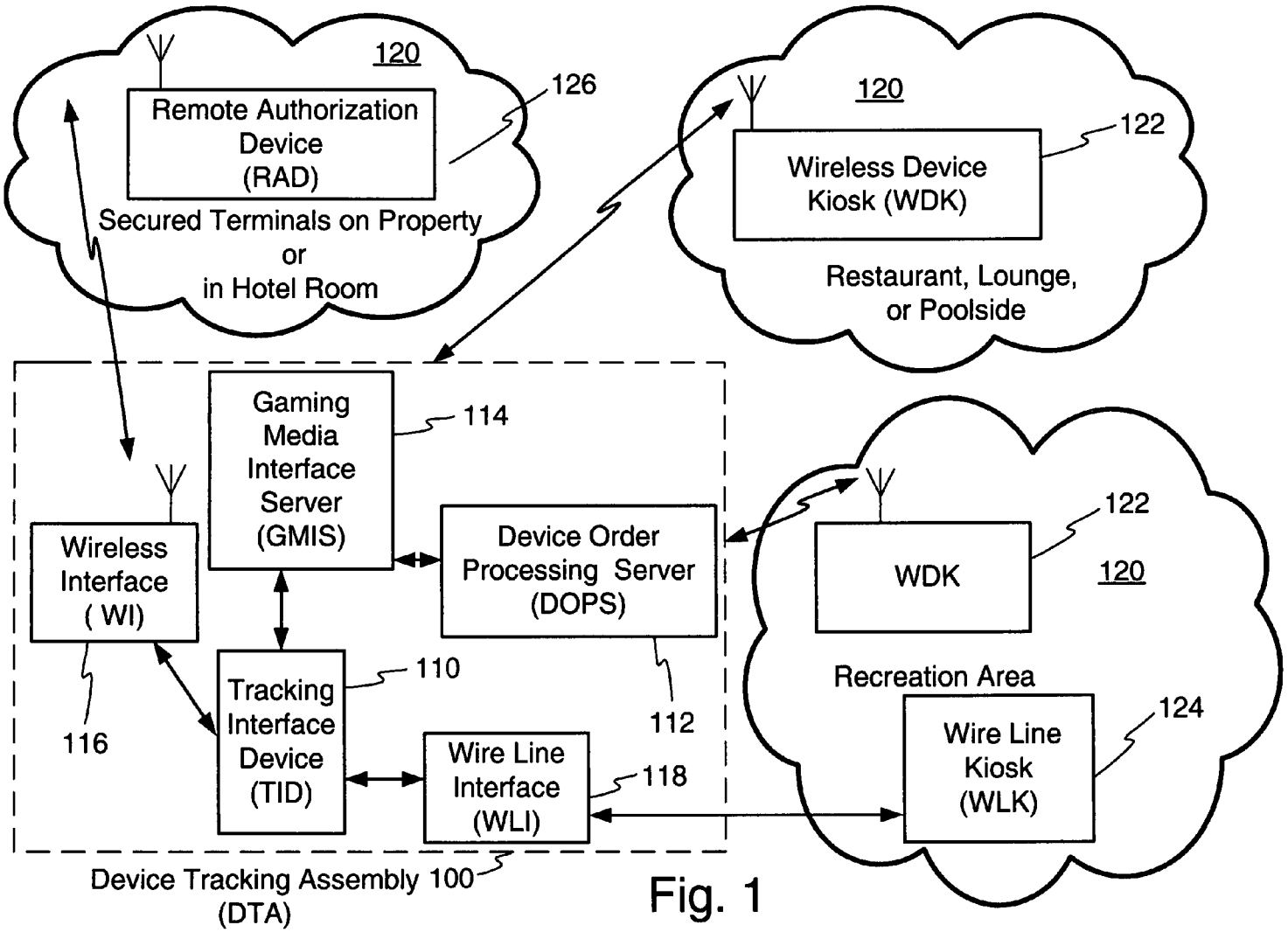
FIG. 1 is a block diagram showing a peer-to-peer (PTP) device tracking assembly according to the present invention.

According to FIG. 1, a remote peer-to-peer wagering gaming system (WGS) comprises a device tracking assembly (DTA) 100. The DTA 100 permits communication between the servers for one or more wagering games and one or more players, which may be located at remote or different locations as described herein. The term remote is defined to mean different locations thereby signifying different players. Group play, such as at a bank of gaming machines or around a table or booth is also contemplated.

In this example embodiment the DTA 100 comprises numerous different elements, many of which may be considered optional. A tracking interface device (TID) 110 may communicate with one or more device order processing servers (DOPS) 112. The DOPS 112 processes player data to authorize player entry into a wagering game environment. The DOPS 112 may further initiate player tracking. Player tracking permits an operator of the wagering game to provide incentives to a player based on a player's wagering activities. Incentive or random award based play is discussed below in more detail.

Furthermore, the DTA 100 may comprise one or more gaming media interface servers (GMIS) 114. In one embodiment, the GMIS 114 provide wagering games and updates gaming activities to one or more players. According to FIG. 1, the GMIS 114 communicates with both the TID 110 and the DOPS 114. Furthermore, in another embodiment the GMIS 114 may communicate to one or more secured media devices (not shown) that provide live or simulated wagering games. The secured media devices may also provide live or simulated player images.

The DTA 100 may further comprise one or more wireless interfaces (WI) 116 and one or more wire line interfaces (WLI) 118. Examples of WI 116 and WLI 118 include routers using various secure communication data protocols. Each WLI 118 is hard wired into the TID 110 and may include high speed cable and fiber optic technology or combinations thereof. High speed cable and fiber optic technology permit nearly real-time communication between the TID 110 and remote players. The WI 116 may include secured cell networks and secured satellite networks or combinations thereof. It is contemplated that other rapid speed interfaces and secure communication protocols may be useful. The TID 110 may be a main computer or a bank of computers or one or more central processing units. The TID 110 may be linked to one or more servers such as the DOPS 112 and the GMIS 114 and one or more routers such as the WI 116 and the WLI 118.

A WI 116 or WLI 118 may receive an initial player input data stream (IPIDS) from one or more secured terminals. The IPIDS includes one or more of the following: verifiable player identity, player account number, player card information, optional biometric data, verifiable currency equivalents, and the like. The term "currency equivalents" means monetary currency notes or coins, redemption slips or redemption cards, credit or debit cards, and the like. The term "biometric data" may include player fingerprints, iris scans, facial profiles, photographs and the like taken at the time of the IPIDS from the player.

Referring to FIG. 1, the secured terminals may include one or more of the following: (a) one or more wireless device kiosks (WDK) 122, (b) one or more wire line kiosks (WLK) 124 or one or more remote authorization devices (RAD) 126. The RAD 126 may be wireless or wire line. One or more players may visit the WDK 122 or the WLK 124 to provide information to an operator representative. In this scenario, the operator representative provides the IPIDS to the TID 110. Alternatively, each player may directly provide IPIDS from one or more RAD 126.

In one embodiment the TID 110 receives IPDIS from a player through one or more of the WI 116 or the WLI 118. The TID 110 communicates each player's IPDIS to the DOPS 112. The DOPS 112 creates a data base for each player and verifies the IPDIS. Upon satisfactory verification of each player's IPDIS, the DOPS 112 authorizes each player to receive or use a PTP device 200 (see FIGS. 2, 3, 4 and 5, and the description below) configured to play one ore more wagering games remotely. The PTP device 200 may comprise any type device, including, but not limited to, a portable tablet or personal computing device, traditional gaming machine, fixed computer or terminal, enabled PDA or cell phone, or any other device configured as disclosed herein. The PTP device may be considered a peer to peer device wherein each player is considered a peer, although communication may occur through a common interface or server. PTP may also be considered as player to player, such that live players play or compete against each other in a virtual or simulated wagering event presented via electronic displays.

The WDK 122, WLK 124 and RAD 126 may be located on a portion of any operator controlled wagering environments. One example of an operator controlled wagering environment includes gaming establishments licensed to provide wagering games. It is contemplated that operator controlled wagering environments may include non-gaming establishments where appropriate security measures have been implemented. Referring to FIG. 1, the WDK 122, WLK 124 and RAD 126 may be located in a hotel room 120 of the gaming establishment, a restaurant 120, a lounge 120, a poolside area 120, a recreation area 120, or any other location. The WDK 122, WLK 124 and RAD 126 may be located in one or more gaming areas designated by the gaming establishment.

Gaming Device

Figure 2:
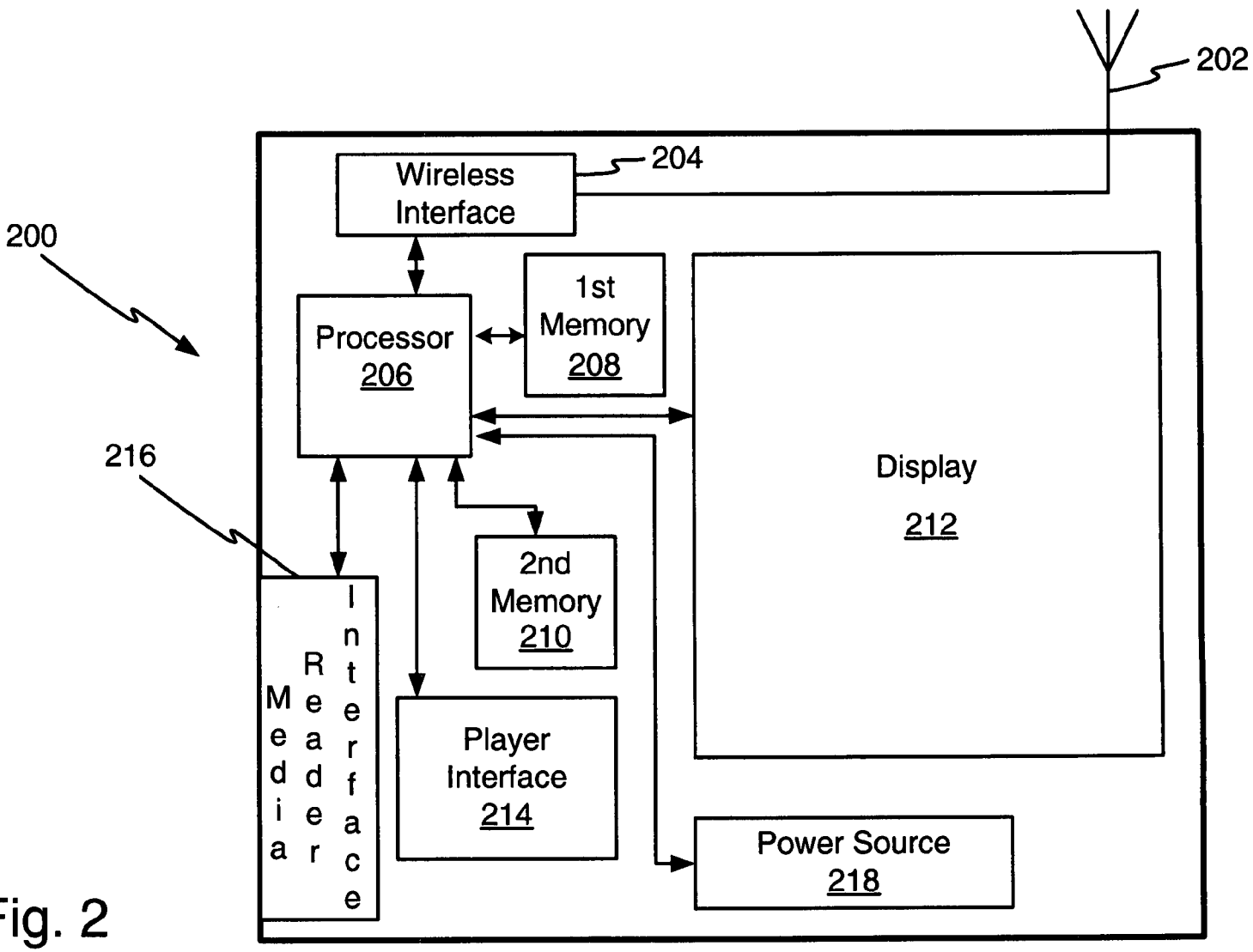
FIG. 2 is a block diagram showing a portion of a wireless device configured for use with the PTP device tracking assembly of FIG. 1.

FIG. 2 illustrates one embodiment of the PTP device 200 issued to an authorized player. The PTP device 200 may comprise any type device capable of receiving and displaying information, to one or more authorized players. The PTP device 200 may further comprise any device capable of sending information, including but not limited to streaming data to a remote location. The information may be, but is not limited to the following: text, vibration (like a playstation controller), audio and images. In one embodiment the PTP device 200 comprises a portable tablet device (see also FIGS. 3 and 4, and the description below). In other embodiments it is contemplated that the PTP device 200 may comprise any secured device authorized by the operator of the remote WGS including, but not limited to the following: a personal station player, a personal digital assistant, laptop computer, web enabled cellular telephone, tablet PC, web pad, or a MIRA Internet appliance and the like.

As shown in the example embodiment of FIG. 2, the PTP device 200 is embodied to communicate over a wireless network. Accordingly, the PTP device 200 includes an antenna 202 which connects to a PTP device wireless interface 204. The antenna 202 and the wireless interface 204 operate in unison to receive signals transmitted from one or more remote locations or to transmit signals to the remote locations. As described above, other systems and methods for communication with remote locations are possible. The wireless interface 204 may perform decoding, demodulation, and other processing as necessary to receive and transmit information with remote locations. It is contemplated that such communication with remote locations would be secured and controlled by the operator of the remote WGS.

In one embodiment communication may occur through a secured wireless cellular network strategically placed in a variety of locations, which may also be used for voice or data communications. It is contemplated that such locations may include a portion of one or more wagering establishments, a portion of any other non-wagering establishments and the like.

The PTP device 200 further may comprise one or more microprocessors 206 or other computing devices such as a DSP, ARM, ASIC, or any type of processors. The microprocessors 206 connect to the PTP device wireless interface 204 to perform analysis and processing on data including but not limited to text, audio and imaging. It is contemplated that data may be sequential or parallel and may be streamed to provide continual and nearly real-time updates.

The processor 206 also connects to or communicates with a first memory 208, a second memory 210, a display device 212, a player interface 214, and a removable media reader 216. The first memory 208 and the second memory 210 may comprise any type memory capable of storing data. In various embodiments the memory 208, 210 may comprise RAM, ROM, a hard disk drive, flash memory, optical memory, CD or DVD ROM, or a CD-RW media. In one embodiment the memory 208, 210 is configured to store any or all of data, software code and programs, video data, pictures, graphics, machine readable code, and processor executable logic code.

The display 212 may comprise any type system configured to display information to a player. In one embodiment the display 212 incorporates touch screen capability for use by a player with a stylus or other pointing device. In another embodiment the PTP device 200 may include a microphone (see FIGS. 3 and 4, and description below) or other similar device to provide audio streaming data to the DTA 100.

The player interface 214 may optionally provide access to additional systems for a player to enter information from the PTP device 200. The player interface 214 may comprise a track ball or mouse type device, one or more keys, buttons, a keyboard, microphone, speaker, voice recognition system, pointing device, or any other device or system capable of receiving input from a player as illustrated and described in FIGS. 3 and 4 below.

The media reader 216 comprises an interface or drive capable of reading, writing, or interfacing with a media. The media may comprise ROM, a hard disk drive, flash memory, optical memory, CD or DVD ROM, or a CD-RW media. In one embodiment the media reader 216 is configured as an input/output port to receive and send data over a hardwired connection. In such a configuration the media reader configured as a port may comprise one of the following: a USB port, Firewire (IEEE1394) port, serial port, or parallel port and the like.

A power source 218 connects to the processor 216 to provide power for operation. Although not shown it is contemplated that the power source 218 may also connect to other systems or devices of the PTP device 200 as necessary to achieve operation and as understood in the art.

The device 200 may be configured to interface with a docking station to receive power, exchange data, or both.

In operation the PTP device 200 receives information over the antenna 202 and the wireless interface 204. Upon receipt of data the processor 206 may reformat the received data for viewing on the display 212 or for use by a player. The data received by the processor 206 via the antenna 202 and the wireless interface 204 may be stored either permanently or temporarily in the first memory 208 or second memory 210 or both.

Alternatively data may be received via the media reader 216. As an advantage of the system shown in FIG. 2, the data used for display to a player may be dynamically received over the wireless link when requested by a player or intermittently received on an update basis to achieve faster operation. It is further contemplated that the PTP device 200 may also be loaded with data, such as through a media reader 216 configured as a port, and thereafter serve as a stand alone system complementary to the DTA 100. Data input through the media reader 216 may be inaccessible by a player after a predetermined time as required by security considerations of governmental or regulatory agencies.

The wireless interface 204 may be further configured using the systems shown in FIG. 2 to receive player input. A player may provide input to the system via the player interface 214 or a touch screen equipped display 212. Any type of information may be received from a player and the type and use of such information is discussed below in greater detail. Player information may be stored in the memory 208, 210 or uploaded to a server for processing and further storage. Other information in addition to or instead of player information may also be received by the PTP device 200.

It is contemplated that the PTP device 200 may execute software to provide an interactive experience to a player. In one exemplary embodiment the system is configured to provide one or more wagering games selected by a player. In this embodiment, a player may select various playing options that are most suited to the player's interactivity preferences. Examples of player's interactivity preferences include, but are not limited to observing other player's facial reactions during play of the game and listening to player's remarks during play of the game. A player of the wagering game may select whether to be observed or not during play of the game (see FIG. 3 and the description below).

In other embodiments the method and apparatus described herein may be configured to offer tournaments of wagering games with multiple wagering opportunities during play of the tournament. In one tournament environment, a player buys into the tournament in hopes of winning a larger award. The player may only play against other players entered in the tournament using the device 200. In another example, playing statistics of teams entered in the tournament may provide multiple wagering opportunities wherein each player may wager on the winning order of teams in the tournament at various stages of the tournament. Another wager based on these playing statistics may be which player of any team scores the greatest cumulative points (as measured in terms of currency equivalent winnings and the like). An advantage of these added wagering opportunities may be to increase player interest and involvement in the tournament wagering games while providing an operator greater income.

In yet another exemplary embodiment, an operator of the remote WGS may configure the PTP device 200 to provide at least one of the following: mystery awards, progressive awards or random prizes and the like. For example, each player's wager may be assigned one or more randomly generated player numbers (or indicia) and a stub (or vector) of each of the numbers represented by a data field for the numbers and for the stubs. At predetermined times a random number generator linked to the wagering game selected by the player may generate a winning number, which is compared to player numbers to determine a winning player. This manner of play may be in addition to that shown below. An advantage of awarding bonus prizes to players may be to increase player excitement and interest in the wagering game.

The PTP device 200 may be configured to randomly award a bonus to a player when the PTP device is issued to the player. This bonus may be currency equivalents or other forms of compensation such as show tickets, food discounts, room rate discounts and the like.

Exemplary Screen Displays

Figure 3:
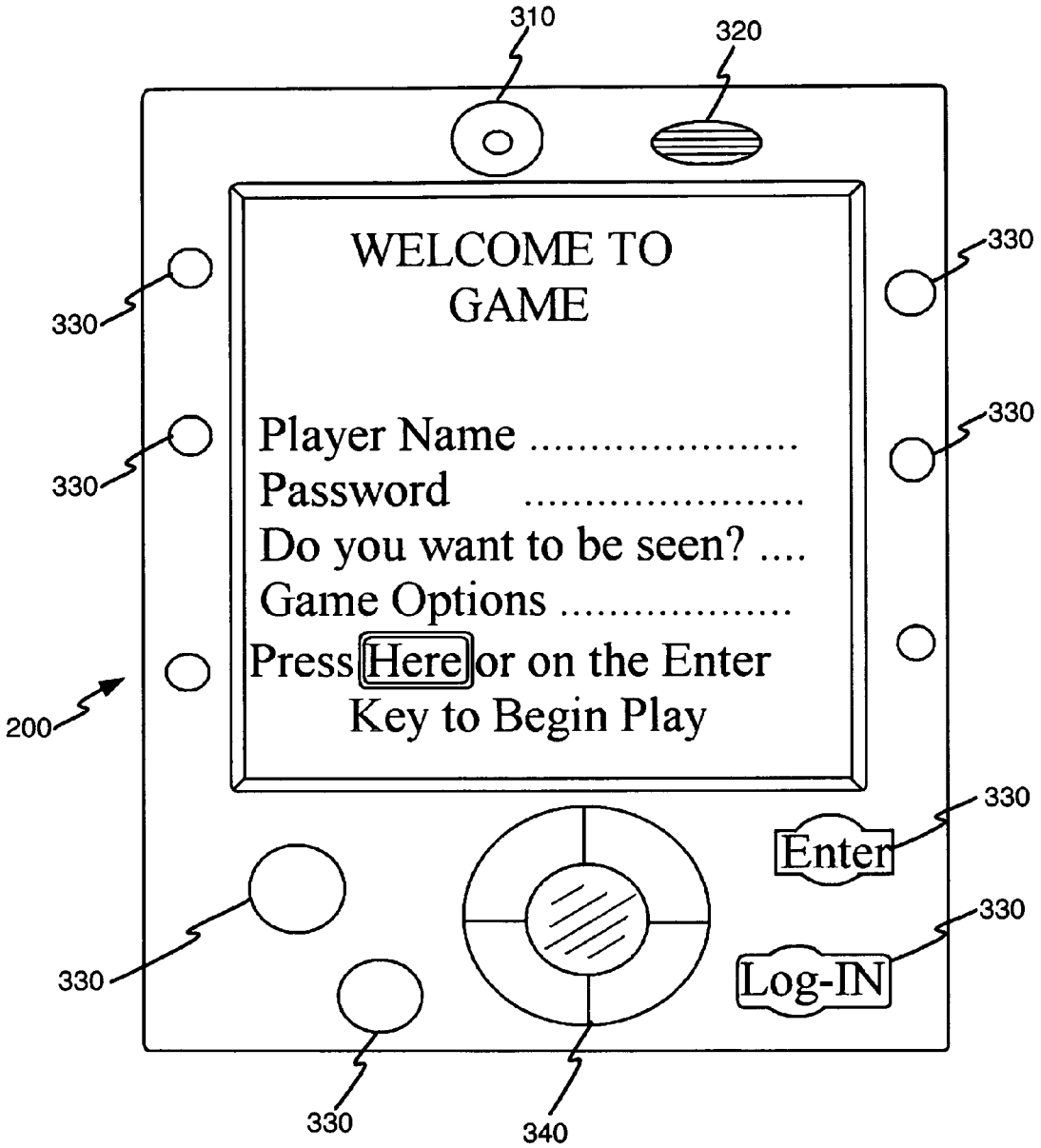
FIG. 3 is a front side view of an exemplary playing device with data on a portion of a display.

FIG. 3 illustrates an example embodiment of a front side of a PTP device 200 configured to play one or more wagering games. In this example embodiment the PTP device 200 comprises one or more media devices used to present a waging game to a player for player versus player play. In an exemplary embodiment, the media devices may include one or more cameras 310 configured to wirelessly communicate with the TDA 100 of the remote WGS. The cameras 310 may provide still or moving images.

Software loaded into the PTP device 200 may provide an interface between each camera 310 and the GMIS 14. For example, analogue visual data may be digitally converted by software loaded in the PTP device 200 using any suitable protocol and thereafter transmitted to the GMIS 14. In one embodiment the GMIS 14 may transmit visual data from each camera 310 to any player of the wagering game. Alternatively, in another embodiment visual data may be received and transmitted from one player PTP device 200 directly to any other PTP device 200, both of which are part of the wagering game.

The camera 310 may have focusing features which automatically track one or more player's facial expressions and hand movements while manipulating the PTP device 200. A player may draw conclusions about other players and may use psychological skills by observing changes in movements.

Alternatively, the camera 310 of a player's PTP device 200 may be selectively deactivated by the player. In one embodiment a player may select to deactivate the camera 310 during initial log-in on the PTP device 200. A player may prefer to be anonymous for personal reasons.

In yet another exemplary embodiment, a wagering game operator may track any player's activities with each camera 310 to provide increased security during play of the wagering game. In this embodiment, an operator may selectively circumvent player deactivation of certain features of each camera 310. It is contemplated that a player may still select whether to be observed by other players of the wagering game.

Similarly, the media devices of the PTP device 200 may comprise one or more microphones 320. The PTP device 200 may further comprise one or more speakers (not shown in FIG. 3). The speakers may be combined with the microphones 320. It is contemplated that the microphones 320 may be configured to wirelessly communicate with the TDA 100 of the remote WGS. Alternatively, audible data may be transmitted or received from any other PTP device 200 of the wagering game. Analogue audio data may be converted to digital data using any suitable protocol embedded within conversion software of the PTP device 200. Each player of the wagering game may selectively both provide and receive audio input during play of the wagering game. In another embodiment of the PTP device 200, it is contemplated that a player may provide audio input to initiate a wagering game.

During play of the wagering game, both visual and audio announcements may be transmitted from the GMIS 114 or from other elements of the TDA 100 to each PTP 200 device. Without any limitation, such announcements may comprise, but are not limited to, the following: prizes awarded to any players of the wagering game as described above, time limits during tournament wagering games, future wagering game availability data, suspension of wagering and the like.

Referring again to FIG. 3, the PTP device 200 may comprise one or more interfaces 330. A player of the PTP device 200 may select one of a variety of player actions with each interface 330. Without limitation, examples of a variety of player actions with each interface 330 may comprise, but it not limited to, the following: wager levels, sound volume, audio quality, alphanumeric data manipulation and the like. FIG. 3 illustrates two specific interfaces 330 such as "Enter" and "Log-IN" that may be located on a portion of the PTP device 200.

In one embodiment any interface 300 may provide more than one function when activated by a player. Additionally, each interface 300 may be further coupled to one or more speakers of the PTP device 200 to selectively emit an audible sound. In yet another embodiment each interface 330 may be coupled to an imaging chip responsive to presenting a visual image on the display 212 of the PTP device 200 when the player manipulates the interface 330. Each interface 330 may further comprise a visual element such as a LED (light emitting diode) which lights when manipulated by a player.

FIG. 3 further illustrates an interface 340 such as a track ball or a joystick configured to position data input by a player on a portion of the display 212. For example, a player may wish to position a cursor next to a text request on the display 212 from the TDA 100 as illustrated in FIG. 3.

The display of FIG. 3 illustrates an example of an initial screen labeled "WELCOME TO GAME". It is understood that the initial screen may be any screen predetermined by an operator of the WGS. In an exemplary embodiment of an appearance of requested data of such an initial screen, without limitation, the initial screen may include the following text: "Player Name", "Password", "Do you want to be seen?", "Game Options", "Press Here or on the Enter Key to Begin Play", and the like.

Figure 4:
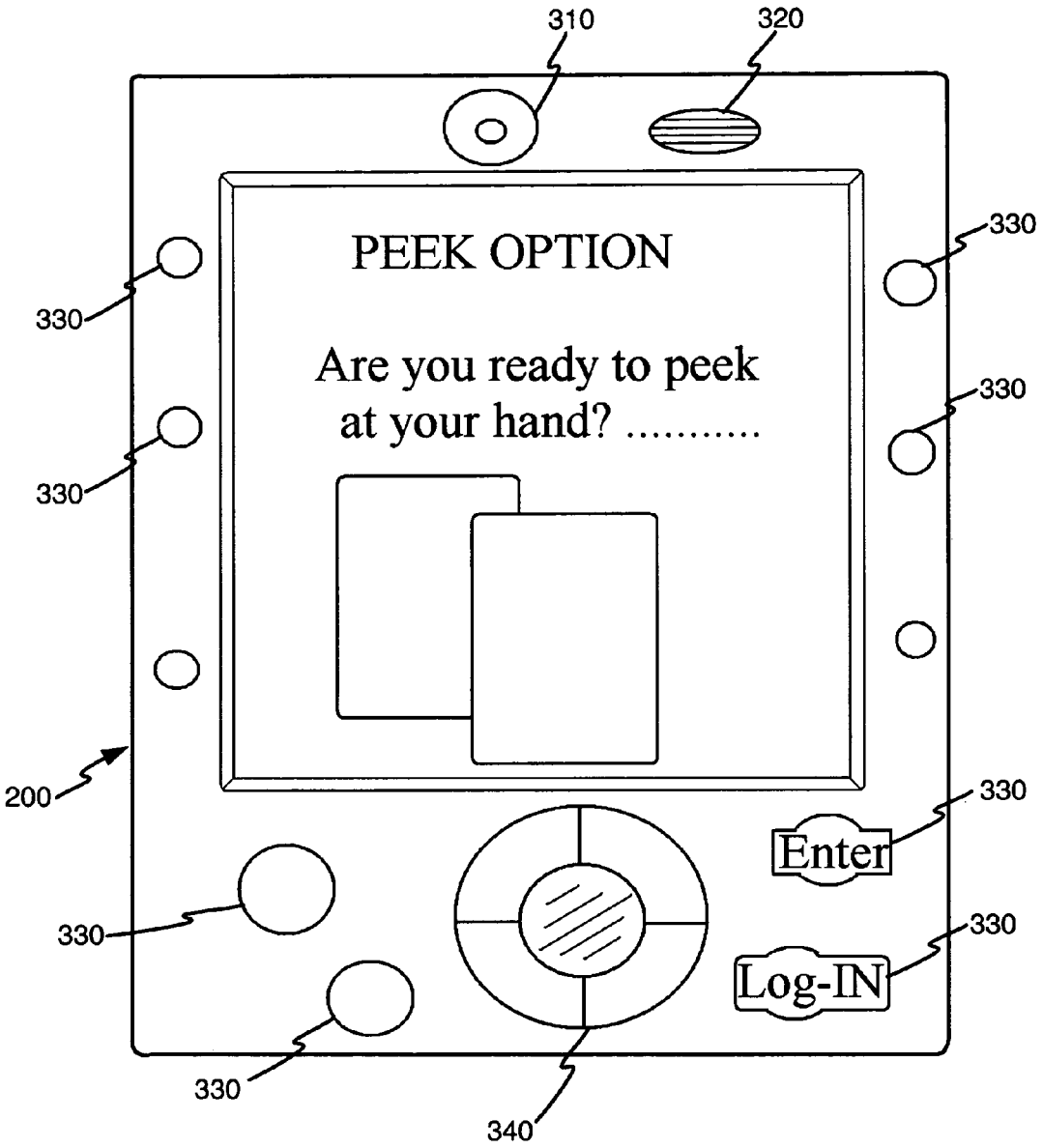
FIG. 4 is a front side view of the playing device of FIG. 3 with other data on a portion of the display.

FIG. 4 illustrates an exemplary screen display of an example embodiment of a peek option screen, comprising one or more player security features that may be presented on the display 212. In this embodiment the security feature may comprise a peek option that appears on the display 212 after two cards are dealt face down to a player. It is understood that the peek option may be used with any indicia of the wagering game. Any interface including but not limited to the microphone 320, the interfaces 330, 340 or merely touching a portion of the display 212 may initiate a viewing of the player's hand. At other times, the players hand may not be visible. In one embodiment a player may select the length of time for viewing the player's hand. An advantage of the peek option may be to limit collusion, cheating, and other undesired behaviors between nearby players of the wagering game.

In another embodiment of player security features, each PTP device 200 may have an identifier indicating the location of the PTP device. The GMIS 14 may audibly or visually announce that a player is nearby another player and suggest caution when revealing a player's hand.

Figure 5:
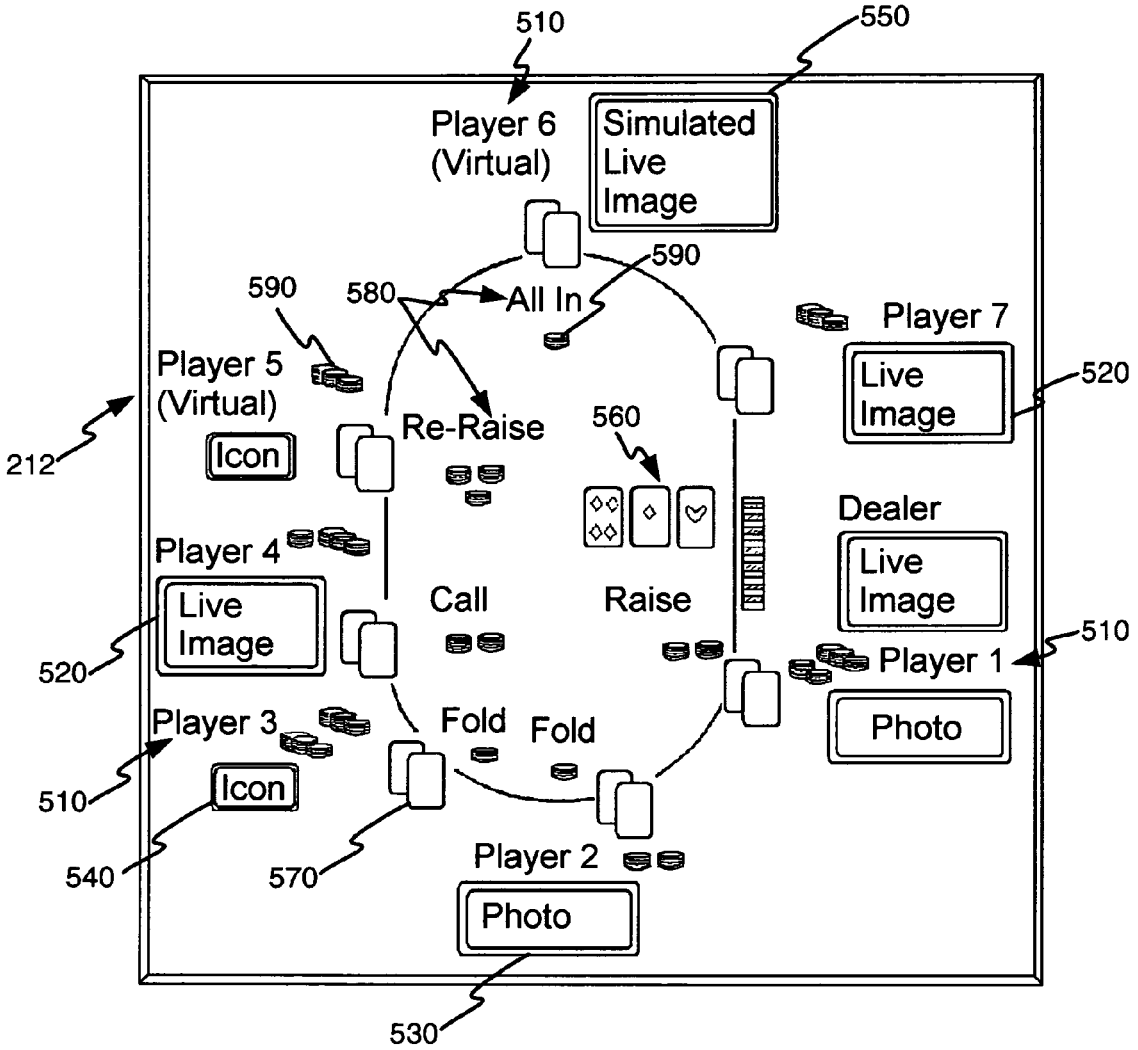
FIG. 5 is a front side view of a portion of the display of the playing device of FIG. 3 showing a wagering game in progress.

FIG. 5 illustrates yet another embodiment of a screen display during play of the wagering game on the display 212. In general and in the embodiment, the devices 200 are used to achieve play in a player versus player game. In this example embodiment the screen replicates a gaming table, such as may be used for live play. According to FIG. 5, each player may be listed by a player number 510. Additionally, each player may be selectively represented as a live or pre-recorded motion image 520, as a still photo 530 or as an icon 540.

In a further embodiment an operator of the WGS may populate the wagering game with one or more virtual players. According to FIG. 5 a virtual player may be represented by an icon 540, a simulated live image 550 or a simulated picture (not shown). Additionally a dealer (denoted Dealer in FIG. 5) may be shown. The dealer may be real or virtual.

In one embodiment of the WGS, both revealed cards 560 and unrevealed player hands 570 may be shown on the display 212. Additionally, in addition to the above described audible sounds, player actions 580 may be displayed as text (such as Fold, Call, Raise) during the wagering game.

In another embodiment of the WGS, a wager of each player may be shown numerically (not shown in FIG. 5) on the display 212 as one or more chips (or any other type of indicia) 590. Additionally, the current status of a player's stake (player's bank balance) may be shown numerically (not shown in FIG. 5) or as chips 590.

It is contemplated that the wagering game may be any type of poker game including, but not limited to comprising any of the following: Texas Hold'Em Bonus, Three Card Poker, Caribbean Stud and Caribbean Draw. In other embodiments the wagering game may comprise any cards game, dice game, other wagering game or combinations thereof wherein one or more players may participate in wagering activities against other players. Wagering activities during play of the game may include normal wagering activities or side wagers.

The wagering game may be a live game, a simulated game generated by an operator of the WGS or any combination of a live game and a simulated game thereof. As can be appreciated, in one embodiment aspects of both a live game, namely player versus player competition is present, although presented in an electronic interface. Advantageously, an operator of the WGS need not provide physical facilities, such as gaming tables, to accommodate the players and additionally the operator may derive income whenever any player participates in the wagering game.

Exemplary Method of Play

Figure 6A:
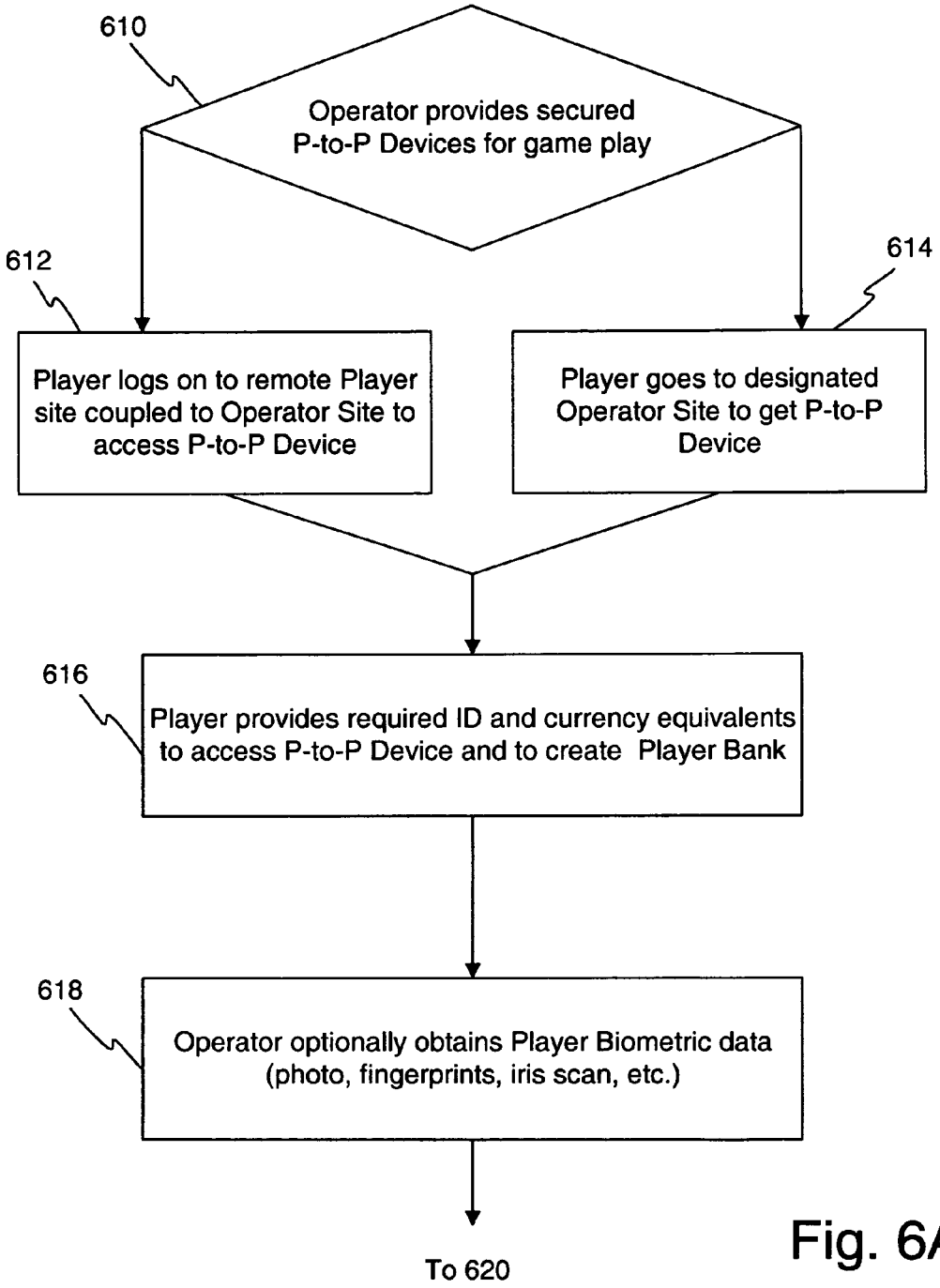
FIGS. 6A-6D illustrate a flow diagram of an exemplary method of play.

FIGS. 6A through 6D illustrates a flow diagram of an exemplary progression of events and method of play. Referring to FIG. 6A, in step 610, an operator initially provides one or more secured PTP devices 200 for game play. In step 612 one or more players, using the PTP devices, may log on to an operator site (the TDA 100) to authorize access for a PTP device 200. The PTP device may be portable and thus taken to any location on the property. Hence, the player may play from a remote location or site, such as their room, pool, lounge, restaurant, cab, show, or the like. Alternatively in step 614, one or more players may go to an operator site to obtain a PTP device 200.

In one embodiment shown in step 616, an operator may requests player information such as an ID (identification) from each player. Each player provides currency equivalents to create a player bank specific to each player. Furthermore, a portion of each player's bank may be a lien for each PTP device 200 supplied to each player.

In step 618, an operator may request optional biometric data from the player such as a photograph taken by the operator, one or more fingerprints, one or more iris scans and the like. Additionally, an operator may request other personal data or provide data such as a password and operator instructions to secure player data and insure player information privacy.

Figure 6B:
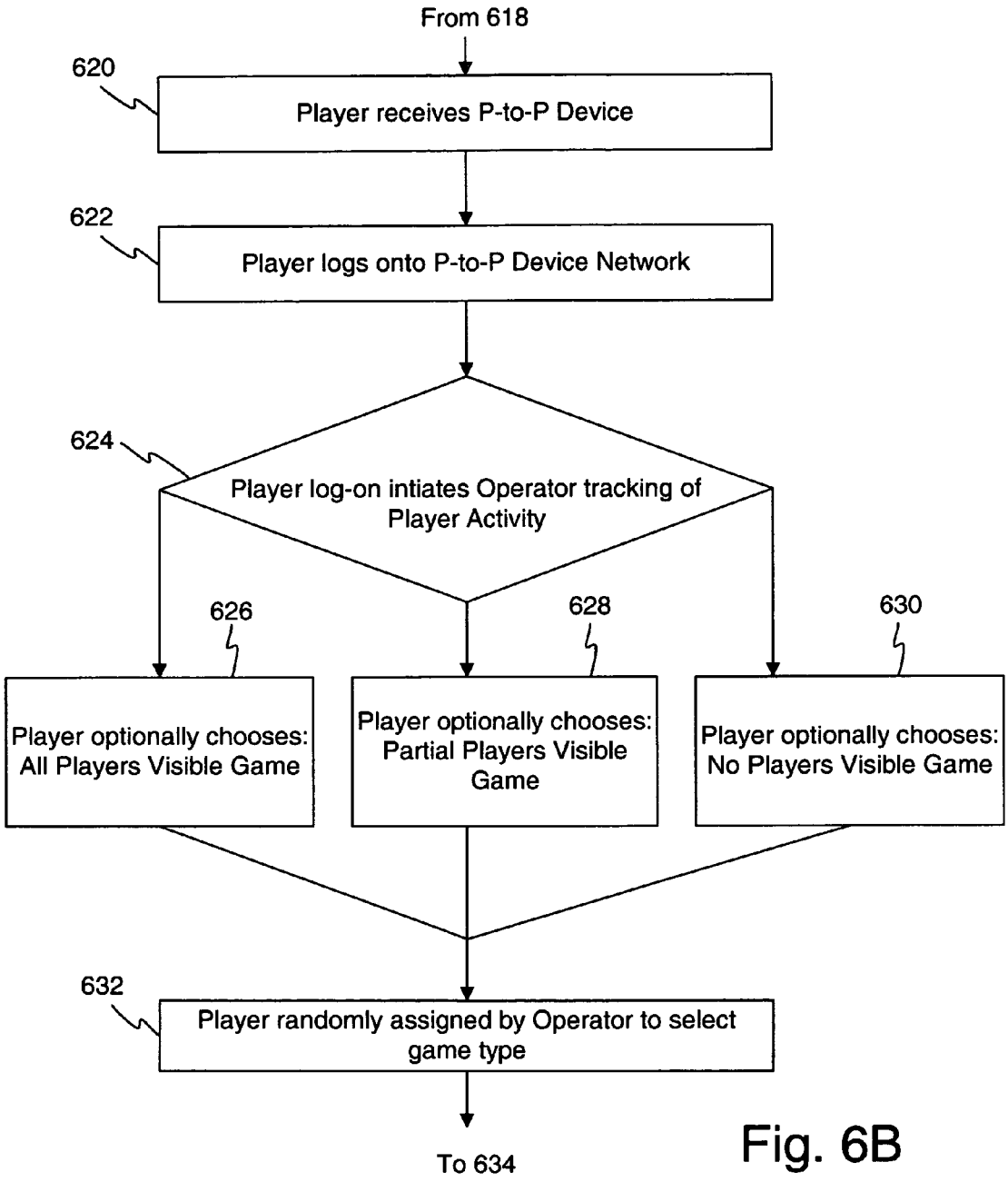

FIG. 6B follows from FIG. 6A. After authorization by an operator of the WGS, in step 620 each player receives an authorized PTP device 200 configured for use by the player. In an exemplary embodiment a player may freely move anywhere with the PTP device 200 on the wagering property or properties.

In step 622 the player may log onto a PTP device network of the WGS to initiate gaming activities. An embodiment of an initial log on screen of the display 212 is shown in FIG. 3 and has been described above. According to step 624, when the player logs on, operator tracking of player activities is initiated. It is contemplated that the operator may track the PTP device at all times.

According to steps 626, 628 and 630, a player may optionally choose one of the following: an all players visible game (step 626), a partial players visible game (step 628) or a no players visible game (step 630). The all players visible game (step 626) provides an environment similar to a live wagering game in a conventional wagering establishment. The no players visible game (step 630) masks player identity during the wagering game and may eliminate player subjectivity during play of the wagering game. The partial players visible game (step 628) provides an environment in-between the previously described options. For example, the player may only be represented by an icon, but all other players may be actual photos or video.

In step 632, an operator of the WGS randomly assigns each player to a wagering game of the type selected by the player. It is contemplated that other players may be part of the game already and thus, numerous live players are joined in an electronic environment to play. This allows a player to participate in one or more live games against other players while physically being located at sports book betting area, by the pool with their family, or in the lounge with friends. It is contemplated that the players may be randomly assigned to a game or request entry to a particular game, such as if a group of friends want to play against each other.

In one embodiment of step 632, an operator may minimize the possibility of player collusion by knowing the location of each PTP device 200. This prevents seeing other players cards or other types of collusion, unfair advantage, or cheating.

Figure 6C:
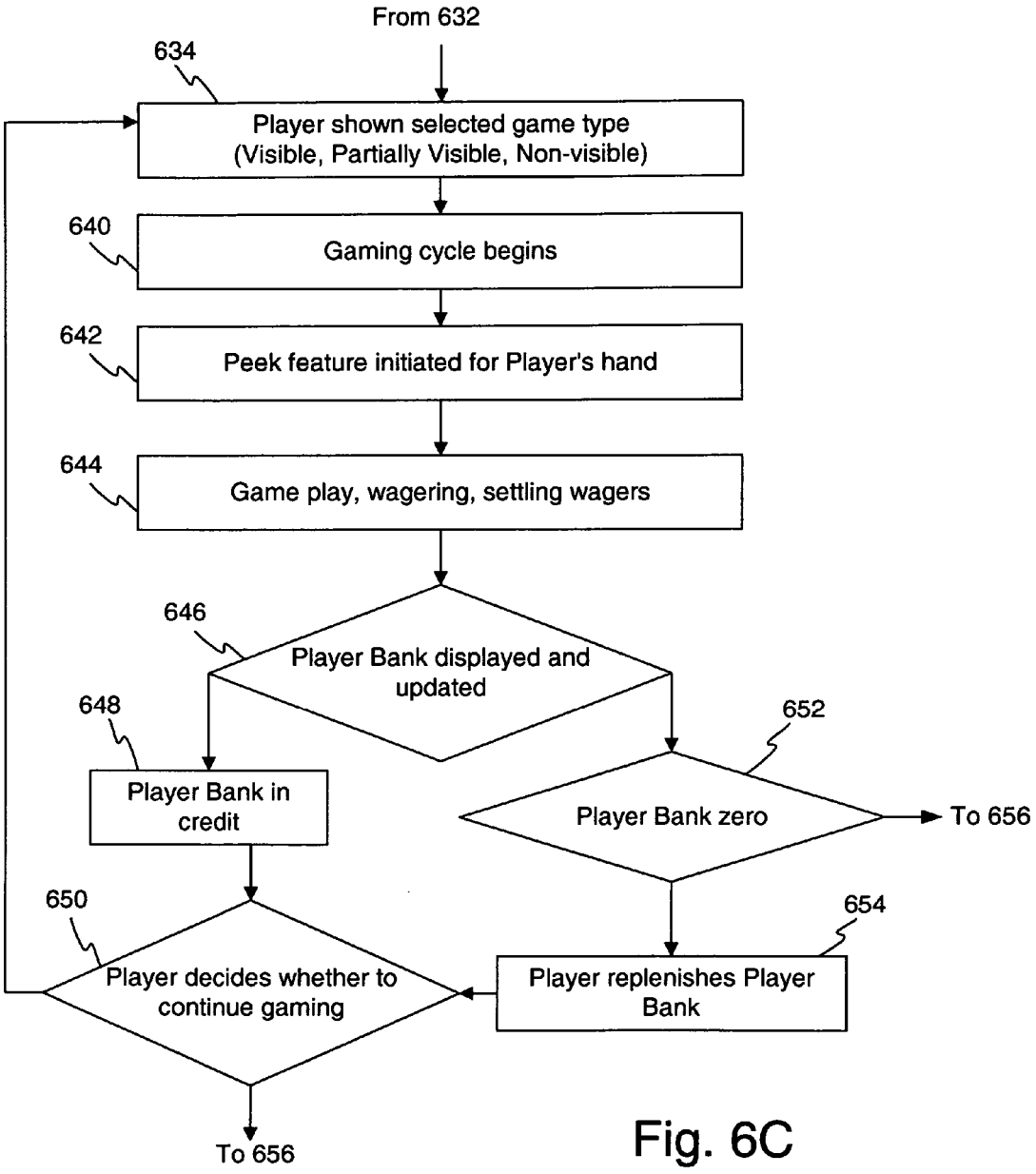

FIG. 6C follows from FIG. 6B. In step 634 each player is shown the player's choice of wagering game after initial log in as shown in FIG. 3 and described above. The gaming cycle of the player's selected wagering game begins at step 640. For each hand of the gaming cycle, in step 642 the player may invoke a peek feature (or peek option) as shown in FIG. 4 and described above.

Depending on the player's selected wagering game, in an embodiment of the WGS, in step 644 the player places wagers, requests further options of the wagering game (such as additional cards, fold, all in, raises and the like), and participates in settling of wagers. In another embodiment of the WGS a player may request a roll of dice or a side bet on the outcome of a tournament style of wagering games (see description above).

In step 646, after completion of the wagering game, the player bank for each player may be displayed on the display 212 of each player's PTP device 200. The player's bank may be updated according to a player's wins and losses during the wagering game. In step 648 a player's bank is in credit, while in step 652 a player's bank has a zero balance. In step 650, where a player's bank is in credit, the player may optionally continue playing in the wagering game. In step 654 a player having a zero balance may optionally replenish the player's bank. It is understood that rules of the current wagering game may not permit a player to replenish the player's bank, and thus they must leave the table having been beat. However, a player may replenish the player's bank to enter another player selected wagering game offered concurrently by the operator.

Figure 6D:
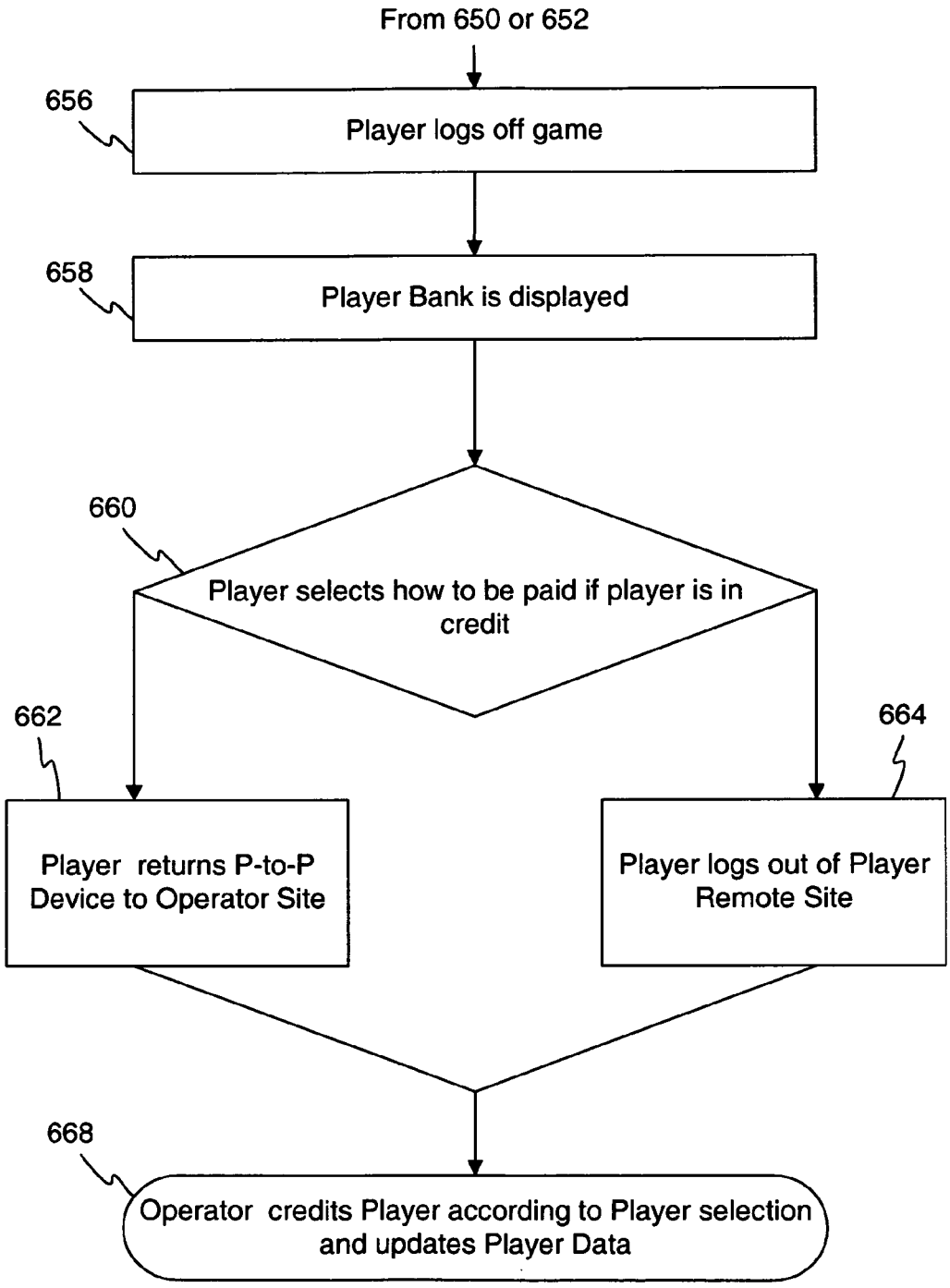

FIG. 6D follows from FIG. 6C. In step 656, if a player decides to leave a wagering game, a player may log off the PTP device 200. It is understood that a player may later decide to re-enter a new wagering game. If a player decides to re-enter a new wagering game, steps 622 through to 656 as described above may be repeated. After log off from the wagering game, the player's bank is displayed on the display in step 658.

If a player has a credit in the player's bank, in step 660 the player may select how to be paid. For example, a player may decide to have a credit returned to a credit card account or to be paid in cash. The PTP device 200 may be configured to provide a hard copy receipt which a player may present to an authorized payment site for cash payment. In an alternative embodiment, a player may select to retain any credit in the player's bank for future play of a wagering game or if in a player's account for other property services or goods.

Steps 662 and 664 provide alternative embodiments showing return of the PTP device 200 to custody of an operator. In step 662, a player returns the PTP device 200 to an operator site such as any WDK 122 or any WLK 124. In step 664 a player logs out of the PTP 200 device at a remote or fixed site. It is contemplated that a portion of hardware or software of a PTP device 200 secured at a remote site may be disabled to prevent use of the remote device 200 by an unauthorized player.

In step 668, after securing the PTP device 200 issued to a player, an operator credits the player according to the player's payment selection and updates any player tracking data at the DTA 100.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A wagering game system for providing a player versus remote player wagering event, the wagering game system comprising:

at least one server configured to:

generate wagering event data for presentation to two or more players where the two or more players play against each other using the wagering event data;

generate a bonus award to be provided to at least one of the two or more players, wherein the bonus award includes at, least one of a progressive jackpot and a mystery jackpot;

a plurality of wagering devices, each configured to present the wagering event data to a player using a respective one of the plurality of wagering devices and located remotely from other players using other respective ones of the plurality of wagering devices and receive player input from the player, each of the plurality of wagering devices including an identifier indicating a current location of the wagering device;

an interface device configured to:

enable wireless communication between the at least one server and the plurality of wagering devices;

transmit wagering device location information to said server;

determine when a distance between two wagering devices is less than a predetermined minimum distance;

generate a warning message to indicate that players may be colluding to cheat the system;

receive a verifiable player identity from a player remote from the plurality of wagering devices;

communicate the verifiable player identity to the at least one server for authorization of the player to receive or use one of the plurality of wagering devices;

communicate with the plurality of wagering devices to provide wagering event data to the plurality of wagering devices received by the interface device from the at least one server; and send player input from the plurality of wagering devices to the at least one server, wherein the player utilizes the at least one wagering device to play against other players based on the wagering event data.

2. The wagering game system as in claim 1, wherein the progressive jackpot is awarded to a player based on a player receipt of a particular poker hand during play on the at least one wagering device.

3. The wagering game system as in claim 1, wherein the mystery award is randomly awarded to a player during play on a respective one of the plurality of wagering devices.

4. The wagering game system as in claim 1, wherein the plurality of wagering devices communicate with the interface device via a wireless communication link.

5. The wagering game system as in claim 4, wherein the plurality of wagering devices is a mobile handheld device configured for use within designated areas in a casino establishment.

6. The wagering game system as in claim 1, further comprising interactive control configured in the at least one server, the plurality of wagering devices, or both, wherein the interactive control determines whether to enable a camera on the at least one wagering device.

7. The wagering game system as in claim 6, wherein the interactive control is configured to display a player selectable icon instead of a picture or video of the player if the camera is not enabled.

8. A wagering game system for providing a player versus player wagering event, the wagering game system comprising:

at least one server configured to:

generate wagering event data for presentation to two or more players where the two or more players play against each other using the wagering event data; and process player data to authorize player entry into a wagering game environment;

a plurality of wagering devices each configured to present the wagering event data to a respective player using a respective one of the plurality of wagering devices and located remotely from other players using other respective ones of the plurality of wagering devices and receive player input from the player, each of the plurality of wagering devices further configured to transmit wagering device location information to said server; the server determining when a distance between the respective one of the plurality of wagering devices and other ones of the plurality of wagering devices playing the same game is less than a predetermined distance; and generating a warning message that the players of the plurality of wagering devices may be colluding to cheat the system; and a tracking interface device configured to:

communicate with the plurality of wagering devices to provide the wagering event data to the plurality of wagering devices; and send player input from at least one wagering device of the plurality of wagering devices to the at least one server, wherein the player utilizes the at least one wagering device to play against other players based on the wagering event data.

9. The wagering game system as in claim 8, wherein the plurality of wagering devices each comprise a vibrating controller.

10. The wagering game system of claim 8, wherein the at least one server is further configured to generate a bonus award to be provided to at least one of the two or more players, wherein the bonus award includes at least one of a progressive jackpot and a mystery jackpot.

11. The wagering game system of claim 10, wherein the progressive jackpot is awarded in response to a particular game outcome received by the player playing on the at least one wagering device.

12. The wagering game system of claim 8, wherein the image of a player is one of a video and a still image.

13. The wagering game system of claim 8, wherein the plurality of wagering devices each comprise a camera configured to capture still image data or video image data.

14. The wagering game system of claim 8, wherein the player may select which wagering event to play on the wagering device.

15. The wagering game system of claim 8, wherein the plurality of wagering devices are configured to determine whether to display an image of the player during play based on player input.

16. A method for offering a wagering event to two or more players, the method comprising:

receiving player data remotely from a wagering device to authorize player entry into a wagering game environment;

providing a wagering device to each of a plurality of authorized players;

generating wagering event data at a central server;

wirelessly transmitting the wagering event data to at least one wagering device located remotely from others of the plurality of wagering devices via an interface device that is coupled to the central server;

receiving, via a wireless link, the wagering event at the plurality of wagering devices;

displaying a wagering event to the plurality of players, the wagering event related to the wagering event data;

accepting one or more wagers from at least one player of the plurality of players in response to the display of the wagering event;

transmitting, via the wireless link, player decision data regarding the wagering event to the interface device;

transmitting the player decision data to the central server;

determining a game outcome and a winning player at the central server;

providing an award to the winning player;

providing a bonus to a player, wherein the bonus includes a mystery jackpot or a progressive jackpot transmitting wagering device location information to the central server from the at least one wagering device;

determining when a distance between the at least one wagering device and another wagering device playing the same game is less than a predetermined minimum distance; and generating a warning message to a player indicating another player is close enough to observe the player's game play.

17. The method of claim 16, wherein the progressive jackpot is award to a player based on a particular game outcome which has been defined to generate a progressive jackpot win.

18. The method of claim 16, further comprising receiving player interactivity input via one of the plurality of wagering devices from one of the plurality of players, wherein the player interactivity input controls whether an image of the player will be shown to other players.

19. The method of claim 16, further comprising capturing an image of at least one of the plurality of players with a camera in at least one of the plurality of wagering devices and displaying the image of the player to other players.

20. The method of claim 16, wherein further comprising causing at least a portion of the plurality of wagering devices to vibrate in response to wagering event data.

* * * * *